United States Patent [19]

Striegler

[11] 4,057,116

[45] Nov. 8, 1977

[54] SLIM HOLD DRILLING

[75] Inventor: John H. Striegler, Richardson, Tex.

[73] Assignee: Atlantic Richfield Company, Los Angeles, Calif.

[21] Appl. No.: 467,947

[22] Filed: May 8, 1974

Related U.S. Application Data

[60] Continuation of Ser. No. 307,544, Nov. 17, 1972, abandoned, which is a division of Ser. No. 223,484, Feb. 4, 1972, Pat. No. 3,724,562, which is a division of Ser. No. 65,177, Aug. 9, 1970, Pat. No. 3,670,832.

[51] Int. Cl.[2] ..... E21B 3/04; E21B 3/10

[52] U.S. Cl. ..... 173/165; 175/195

[58] Field of Search ..... 173/57, 163–165, 173/52, 166, 167, 151, 79; 175/170, 171, 85, 195; 408/124, 123; 310/58

[56] References Cited

U.S. PATENT DOCUMENTS

| | | | |
|---|---|---|---|
| 545,109 | 8/1895 | Storey | 173/151 |
| 1,499,696 | 7/1924 | Rudenburg | 310/58 |
| 2,016,785 | 10/1935 | Lawlor | 173/79 X |
| 2,245,960 | 6/1941 | Claire | 173/165 X |
| 3,103,676 | 9/1963 | Kehaly | 408/124 UX |
| 3,472,553 | 10/1969 | Miller | 299/5 |

OTHER PUBLICATIONS

Brantly, *History of Oil Well Drilling,* Gulf Publishing Co., 1971, p. 988.

*Primary Examiner*—Ernest R. Purser
*Assistant Examiner*—William F. Pate, III
*Attorney, Agent, or Firm*—Roderick W. MacDonald

[57] ABSTRACT

A slim hole drilling method wherein a wellbore of a diameter no greater than about 6 inches is drilled using a drill pipe rotation rate of at least 500 rpm and rotating the drill pipe with at least one electric motor operably connected to the drill pipe. Drilling power units for carrying out the drilling method which employ at least one electric motor in mechanical connection with the drill pipe for rotating the drill pipe and moving with same as it advances toward and away from the wellbore.

2 Claims, 6 Drawing Figures

SLIM HOLD DRILLING

CROSS REFERENCES TO RELATED APPLICATIONS

This is a continuation of application Ser. No. 307,544, filed Nov. 17, 1972 now abandoned; which in turn is a division of application Ser. No. 223,484, filed Feb. 4, 1972, now U.S. Pat. No. 3,724,562; which in turn is a division of application Ser. No. 65,177, filed Aug. 19, 1970, now U.S. Pat. No. 3,670,832.

BACKGROUND OF THE INVENTION

As an exploratory tool, it can be desirable to drill very small diameter boreholes, hereinafter referred to as "slim hole" drilling. Whereas a conventional wellbore may start with a diameter of about 20 inches, a slim hole wellbore would start with a diameter of no greater than about 6 inches. By drilling small diameter boreholes, larger numbers of exploratory wells can be drilled more economically. In addition, the drilling rig necessary for these smaller diameter boreholes is lighter thereby allowing for more economical moving of the rig from one drilling location to another.

With slim hole drilling much greater than conventional rotation rates for the drill pipe and bit are employed. Whereas conventional rotary drilling uses rotation rates no greater than about 350 rpm, and most usually in the range 50–150 rpm, slim hole drilling is preferably carried out at no less than about 500 rpm.

Heretofore in offshore rigs in order to gain more working room on the working floor of the rig, the rotary table has been replaced by an electric motor hung in the derrick, U.S. Pat. No. 3,426,855. However, the method and equipment used in such a drilling setup was for conventional size boreholes drilled at conventional rotation rates and therefore was not suggestive for slim hole drilling. Nor was it known whether such equipment would or could be made to stand up under the unique rotation and vibration conditions encountered only with slim hole drilling techniques.

SUMMARY OF THE INVENTION

It has now been found that slim hole drilling techniques can be carried out successfully with an electric motor drive by employing a method comprising rotary drilling a wellbore having a diameter no greater than about 6 inches, rotating the drill pipe during at least part of the drilling procedure at a rate of at least 500 rpm, rotating the drill pipe with at least one electric motor operably connected to the drill pipe itself, and moving the electric motor with the drill pipe as it moves in relation to the wellbore.

The electric motor drilling apparatus utilized for conventional drilling in an offshore rig was not acceptable as such for slim hole drilling because external air cooling hoses connected to the motor frame slowed movement of the motor and therefore slowed the drilling process and because there was more danger of a cooling failure by breakage of a cooling hose.

Accordingly, an electric drilling power unit useful in carrying out the method of this invention comprises a housing having torque arms extending laterally therefrom, an electric motor carried in the housing as hereinafter described, and at least one fan means carried by the housing and adjacent to the electric motor, the fan means having an inlet means communicating with the exterior of the housing and an outlet means directing the output of the fan against the motor's stator and a rotor.

Another suitable power unit comprises a drill pipe section having at least one gear means attached thereto, an electric motor for each gear means attached to the drill pipe section, the electric motor carrying its own gear for meshing with the gear means attached to the drill pipe section.

In both power units the electric motors are supported in such a manner as to be movable toward and away from the wellbore as the drill pipe moves toward and away from the wellbore.

In another embodiment the power units of this invention are employed in the rig floor instead of in the air.

Accordingly, it is an object of this invention to provide a new and improved method for slim hole drilling. It is another object to provide new and improved drilling power units for slim hole drilling methods. It is another object to provide a method and apparatus whereby electric motors can be employed in slim hole drilling techniques without sacrifice in economy or reliability of operation.

Other aspects, objects and advantages of this invention will be apparent to those skilled in the art from this disclosure and the appended claims.

DETAILED DESCRIPTION OF THE INVENTION

Figure 1:
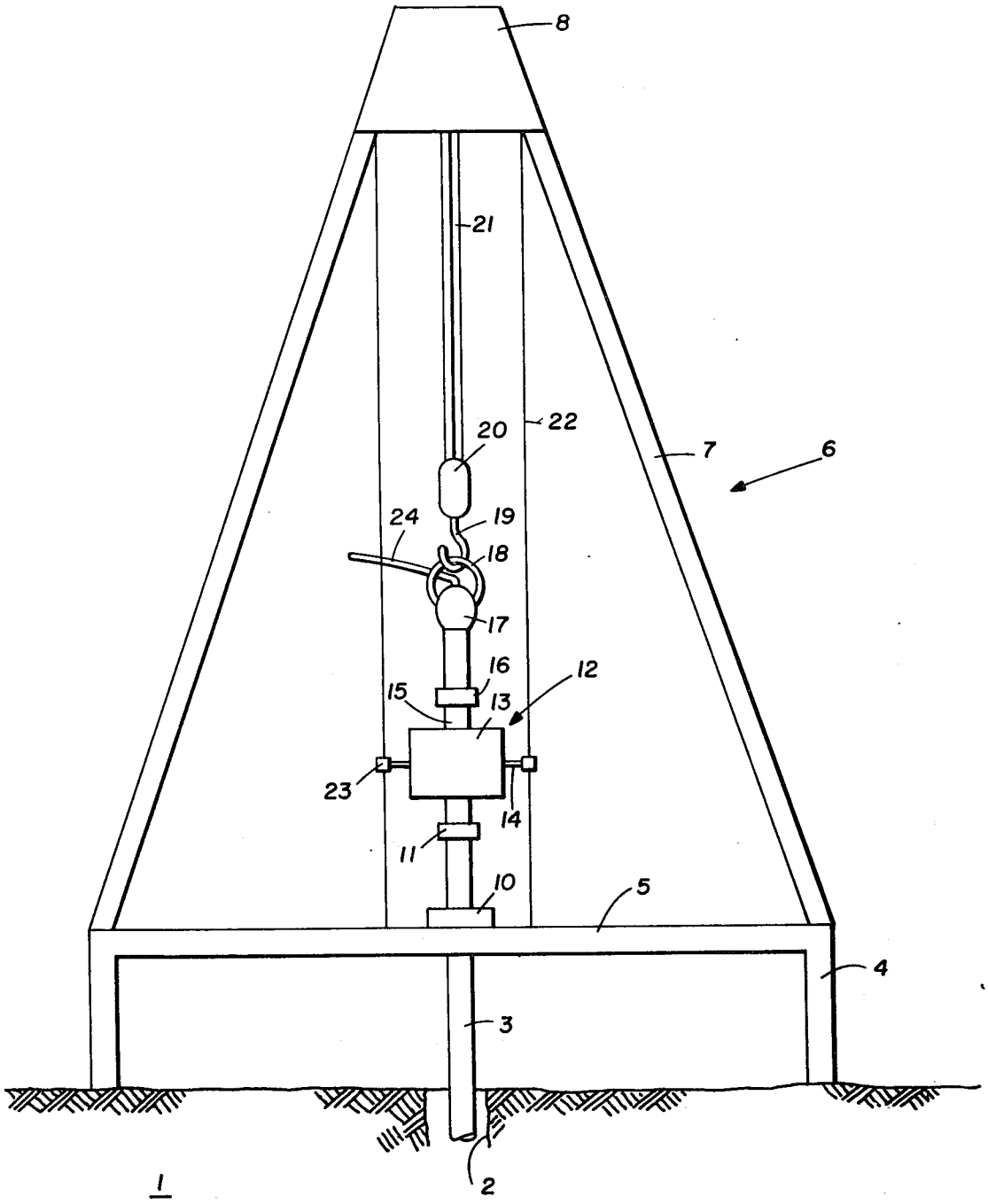
FIG. 1 shows an elevation of a drilling rig employing one embodiment of this invention.

FIG. 1 shows the earth 1 having a wellbore 2 therein and a section of drill pipe 3 extending thereinto. A drilling platform 4 with its working floor 5 is disposed over wellbore 2. The derrick 6 sitting on platform 4 has, for sake of clarity, been simplified to show only two supporting legs 7 surmounted by a conventional crown block 8.

Drill pipe 3 extends through an opening in floor 5 and an opening in spider 10 to coupling 11. Spider 10 is employed to hold slips which support the drill pipe in the wellbore when the apparatus above coupling 11 is disconnected. A rotary table of a typical drilling rig can also be used for this purpose.

Drilling power unit 12 is described in greater detail hereinafter with respect to FIGS. 2 and 3. As shown in FIG. 1, power unit 12 comprises a housing or support means 13 having torque arms 14 extending laterally therefrom and a hollow electric motor shaft 15, the motor being carried interiorly of housing 13, extending above and below housing 13. Shaft 15 is connected to coupling 11 below housing 13 and to coupling 16 above housing 13. Coupling 16 is connected to swivel 17 whose bail 18 is supported by hook 19, traveling block 20, and wire cables 21 which are supported by sheaves in crown block 8.

Torque arms 14 are slideably connected to members 22 which are fixed to floor 5 and crown block 8 so as to provide fixed members which are substantially parallel to but spaced from drill pipe 3 and over which torque arm adapters 23 can slide so as to render housing 13 movable with drill pipe 3 as the pipe advances into or out from wellbore 2. The torque arms can follow mechanical tracks or another guide means as desired.

In operation, power unit 12 is utilized to rotate drill pipe 3 which carries any type of rotary drill bit (not shown) at the bottom end thereof. Wellbore 2 is thereby drilled deeper until coupling 11 is just above spider 10. At this time shaft 15 is disconnected from coupling 11, another section of drill pipe attached to the lower end of shaft 15, power unit 12 raised in the derrick by raising hook 19 until the lower end of the new section of drill pipe can be attached to coupling 11, and drilling continued until wellbore 2 is deepened so that coupling 11 is again near the top of spider 10. This sequence of events is then repeated until wellbore 2 is drilled to the desired depth. Thus, it can be seen that power unit 12 is raised and lowered in the derrick a large number of times using hook 19 with torque arms 14 following along fixed members 22. Fixed members 22 can be wire cables which can be slackened to move power unit 12 over to connect with a new drill pipe section or can be any other type of fixed or fixable member as desired.

Figure 2:
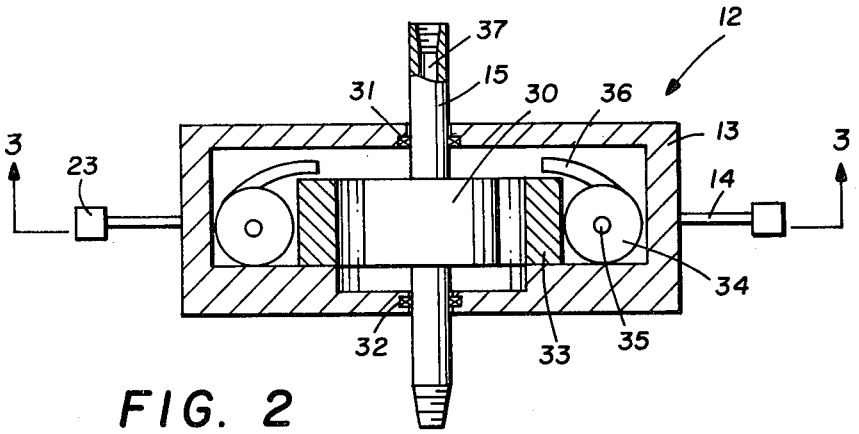
FIGS. 2 and 3 are cross sections of a drilling power unit embodying one aspect of this invention.

FIG. 2 shows an elevational cross-section of power unit 12 wherein housing 13 is seen to contain an electric motor having its rotor (armature) 30 fixed to hollow shaft 15 which is rotatable within housing 13 by means of combination thrust and radial bearings 31 and 32. Stator 33 is carried in housing 13 around rotor 30. Around the exterior of stator 33 and interiorly of housing 13 are two fan means 34 having air inlet means 35 connected to the exterior of housing 13 as shown in FIG. 3 and also having outlet means 36 which direct the output of the fan means against rotor 30 and stator 33. The upper and lower ends of shaft 15 are threaded for releasable attachment with coupling means 11 and 16. Shaft 15 is hollow in that it contains a passageway 37 connecting one threaded end to the other threaded end so that drilling mud from gooseneck 24 of FIG. 1 can pass through swivel 17, and shaft 15 into drill pipe 3.

Various control steps can be taken with the electric motor which are useful for slim hole drilling and which can readily be achieved with electric motors. Desirable controls, one or more of which can be employed in any particular process, include a motor torque output limit, motor torque output reading device, motor rpm control, forward and reverse rotation by the motor, and a motor torque output limit and motor speed control for use when threading one drill pipe into another drill pipe or unthreading one drill pipe from another drill pipe.

The particular apparatus useful in carrying out each control step varies widely depending primarily on whether the motor is an alternating current motor or a direct current motor and which species of alternating current or direct current motor is employed. In addition, more than one type of apparatus can be employed on any given motor to achieve the desired control steps. All such electrical control apparatus, once given a particular motor, is known in the art and can be readily devised by one skilled in the art.

For example, it is preferred that the electric motor be a direct current motor. A particularly preferable type of direct current motor is the shunt type direct current motor which is well-known in the art. With this type motor one method by which the torque output can be limited to a desired maximum value is by sensing the field current and armature current and combining the two values such as by multiplication, the resulting value being representative of the torque output of the motor which can then be compared with the maximum desired torque output for the motor. If the measured value of torque output for the motor is less than the maximum set value the motor continues to operate in an open loop fashion unless and until the maximum set torque value is exceeded. When the maximum set torque value is exceeded, conventional apparatus such as a Thyristor circuit can be used to reduce the armature current to the motor thereby reducing the torque output of the motor to the maximum set value.

Direct readout of the actual torque output of the motor can be accomplished by simply employing a conventional ampmeter which registers the magnitude of the value of the combined, sensed armature current and field current.

Control of the rotational speed of the shunt type direct current motor can be achieved simply by varying the armature voltage. With this type motor, for a given field excitation, speed varies directly with applied armature voltage, but by weakening (reducing) the field excitation the same applied armature voltage will result in a high speed. The field excitation can be weakened in any conventional manner such as by inserting magnetic amplifier controlled reactors on the secondary side of the transformer supplying the field rectifier.

The reversing step for the shunt type direct current motor can be simply accomplished by reversing the current through the shunt field in a conventional manner. The motor can also be reversed in its direction of rotation by reversing the voltage on the armature. The forward and reverse drives for the motor can be combined with the torque limit and speed control steps described hereinabove when threading or unthreading sections of drilling pipe. For example when threading one section of drilling pipe into another, a torque limit step can be employed so that excessive torque cannot be applied to the pipe joints upon completion of the threading step. This avoids risk of damaging or breaking apart the threaded joint. Similar reasoning applies to unthreading one pipe from another in that a torque limit step is used and in combination therewith a speed control is used which decreases the rotational speed of the electric motor as soon as the torque on the motor decreases significantly which is indicative of the two sections of pipe starting to be unthreaded and which avoids acceleration in rotational speed of the driven section of pipe after it starts unthreading from the fixed section of pipe.

Additionally, various warning alarms can be employed as desired. For example, a heat sensing device can be employed on the electric motor itself which actuates a light, buzzer, or other alarm when the motor extends the preset maximum temperature. Similar warning controls can be employed on the motors of fans 34 so that if the current to power unit 12 is interrupted the operator is warned of a cooling failure in the power unit.

Figure 3:
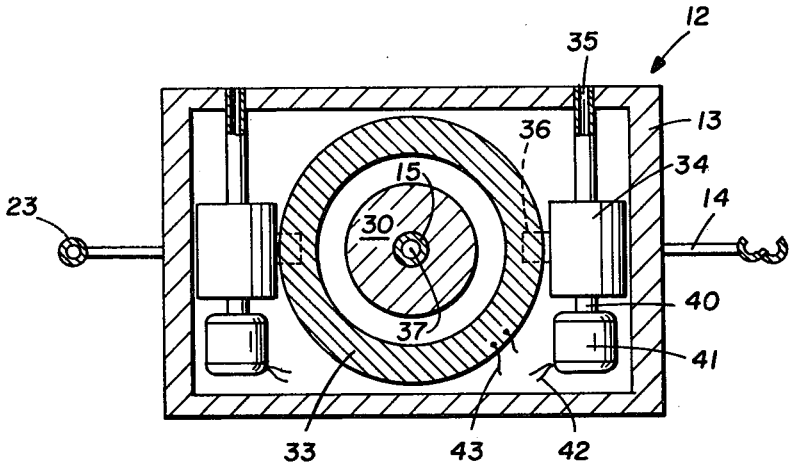

FIG. 3 shows a bottom cross-sectional view of power unit 12 along the line III—III of FIG. 2. FIG. 3 shows a pair of fan means 34 having air inlet conduit means 35 open to the atmosphere around the exterior of housing 13. Fan means 34 are connected by way of shafts 40 to powering motors 41. Electric wires 42 from motors 41 and electric wires 43 from stator 33 are combined into a single cable bundle which passes through the exterior of housing 13 (not shown), up along swivel 17 and along gooseneck 24 to a power source (not shown) located on the ground somewhere in the vicinity of platform 4.

By the apparatus of power unit 12, with a plurality of fan means arranged interiorly of housing 13 and around the electric motor within housing 13, the fan means each being in direct and open communication with ambient air by means of conduits 35 and each having its output directed at the motor on the interior of housing 13, the large and critical demand for cooling of this motor while operating at high slim hole rotation rates can be met without adverse effects on the motor itself. Also, only a single energy supply conduit needs to run out of housing 13, this line being a single electrical conduit. In this manner the need for running one or more air hoses along gooseneck 24 and swivel 17 to housing 13 is eliminated and power unit 12 is rendered more reliable since no risk is involved of breaking a cooling air hose by constant flexing with movement of power unit 13 up and down in derrick 6.

Accordingly, power unit 12 provides the critical cooling requirement for the electric motor under the strenuous slim hole operating conditions and at the same time is substantially more reliable since there are no flexing parts supplying the cooling air to the motor. By use of this unit, there is no risk of an unseen cooling air hose leak, which can cause overheating and failure of the power unit motor. The cooling demand for the power unit motor when operating at the high rotational speed of slim hole drilling is great and even a small loss in cooling air cannot be tolerated without some adverse overheating of the motor.

Figure 4:
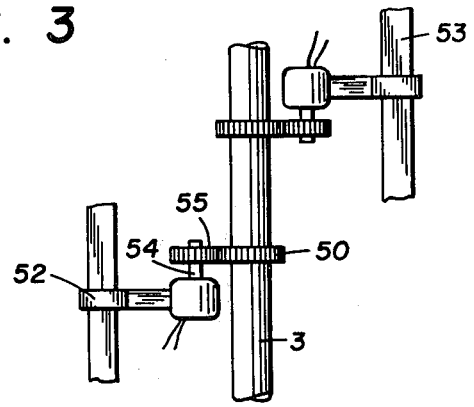
FIG. 4 is an elevation of another drilling power unit embodying another aspect of this invention.

FIG. 4 shows drill pipe 3 having two gears 50 attached directly to the drill pipe section. Two electric motors 51 are supported by individual torque arms 52 which torque arms are slideably movable along a fixed member 53. Member 53 can extend between floor 5 and crown block 8 in the same manner of fixed members 22 in FIG. 1. Each motor 51 carries its own gear means 55 by way of shaft 54, each gear means 55 being enmeshed with one gear 50.

The apparatus of FIG. 4 constitutes a drilling and power unit which can be used in lieu of power unit 12 of FIG. 1, the upper end of drill pipe section 3 of FIG. 4 being connected by way of coupling 16 to swivel 17 of FIG. 1 and the lower end of drill pipe section 3 being connected by way of coupling 11 to the remaining drill pipe extending into wellbore 2.

In operation, as wellbore 2 is deepened, drill pipe section 3 of FIG. 4 moves downwardly and so do motors 51 by way of sliding of torque arms 52 along fixed members 53. Of course, if desired, suitable housing can be provided around the apparatus of FIG. 4 to insure that as drill pipe section 3 moves, motors 51 move without disengaging any of the enmeshed gears 50 and 55. This would be obvious to one skilled in the art and, for sake of simplicity, is not shown. Of course, if desired, a single motor 51 operating on a single gear 50 or more than two motors 51 operating on more than two gears 50 can be employed. Similarly, more than one motor can be employed inside housing 13 of power unit 12 if desired.

The method of this invention comprises rotary drilling a wellbore having a diameter no greater than about 6 inches, preferably from about 2 inches to about 5 inches, rotating the drill pipe during at least part of the drilling at a rate of at least 500 rpm, preferably from about 600 to about 2000 rpm, rotating the drill pipe with at least one electric motor which is operably connected directly to the drill pipe itself, and moving the one or more electric motors used to rotate the drill pipe with the drill pipe as it moves relative to the wellbore.

Figure 5:
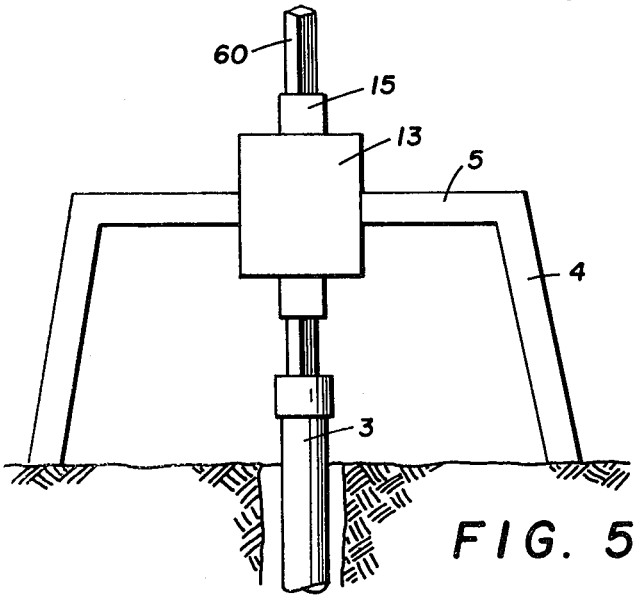
FIG. 5 shows an elevation of part of the rig of FIG. 1 wherein the power unit is located in the rig floor.

In FIG. 5 only platform 4 and floor 5 of the rig are shown for simplicity. In FIG. 5 the power unit 13 is fixed in floor 5 in the opening normally occupied by the rotary table of a conventional rig. In this embodiment hollow shaft 15 has its interior adapted to receive and drive a conventional Kelly 60. For example the interior of shaft 15 can be square in cross section to allow a square Kelly to pass therethrough.

Figure 6:
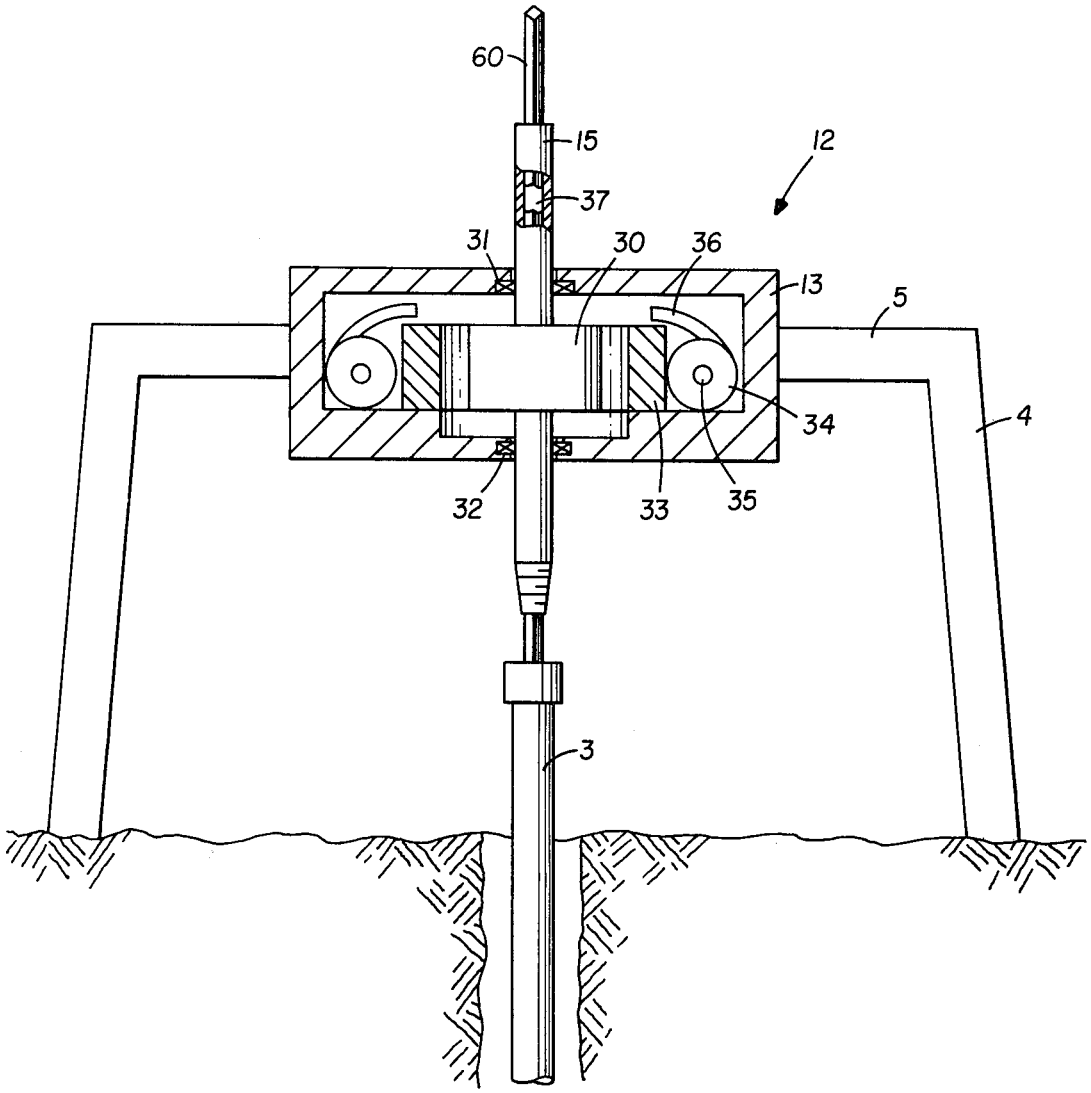
FIG. 6 shows the drilling power unit of FIG. 2 mounted in the rig floor of FIG 5.

The upper end of Kelly 60 is connected to swivel 17 in a conventional manner. Thus, the rig is operated during drilling in the conventional manner except that a power unit of this invention is utilized in lieu of the conventional rotary table with the hollow shaft of the direct current motor of the power unit driving the Kelly. This rig floor capability is advantageous in that it is very difficult to obtain the high speed of rotation required for slim hole drilling with mechanical drives on a conventional rotary table. For example, it is difficult to obtain 1500 rpm with a mechanical drive and even then the drive mechanism does not hold up well or for long. In FIG. 6, power unit 13 is fixed in floor 5. FIG. 6 shows power unit 13 to contain an electric motor having its rotor 30 fixed to hollow shaft 15 which is rotatable within housing 13 by means of combination thrust and radial bearings 31 and 32. Stator 33 is carried in housing 13 around rotor 30. Around the exterior of stator 33 and interiorly of housing 13 are two fan means 34 having air inlet means 35 connected to the exterior of housing 13 as shown in FIG. 3 and also having outlet means 36 which direct the output of the fan means against rotor 30 and stator 33. Shaft 15 is hollow and passageway 37 of hollow shaft 15 has its interior adapted to receive and drive conventional square Kelly 60.

EXAMPLE

A wellbore was drilled using substantially the apparatus shown in FIGS. 1 through 3.

The wellbore had a diameter of substantially 3¼ inches starting at the bottom of the 4½ inch O.D., surface pipe set at 128 feet and extending down to 4186 feet, the total depth of the wellbore. The wellbore was drilled using 2 1/16 inch diameter drill pipe and a diamond bit, the electric motor in housing 13 being a 350 horsepower motor which was operated so as to rotate the drill pipe at about 1500 rpm during substantially all the drilling of the wellbore.

During the drilling, the lifting capacity on hook 19 was adjusted so as to maintain a weight of approximately 8000 pounds on the drill bit during rotation at about 1500 rpm. A conventional water based drilling mud was employed during drilling.

Both fans 34 were operated at full capacity of 2000 cubic feet per minute during drilling and no failure of cooling or overheating of the motor in power unit 12 was encountered during drilling of the entire wellbore.

Reasonable variation and modifications are possible within the scope of this disclosure without departing from the spirit and scope of this invention.

The embodiments of the invention in which an exclusive property or privilege is claimed are defined as follows:

1. In a drilling rig having a space in its floor for a rotary table, the improvement comprising a power unit carried by said rig floor in the space for said rotary table, said power unit comprising a support means carried by said rig floor in the space for said rotary table, an electric motor means having a hollow rotor shaft, said motor means being carried by said support means so that the ends of its rotor shaft extend above and below said support means, said rotor shaft being adapted to receive a kelly in its hollow interior to drive said kelly.

2. A drilling power unit according to claim 1 wherein said support means is a housing and at least two fan means are carried interiorly of said housing and spaced around said motor means within said housing, each fan means having its inlet means operatively connected to the exterior of said housing and its outlet means adapted to cool said motor means.

* * * * *